US005467977A

United States Patent [19]

Beck

[11] Patent Number: 5,467,977

[45] Date of Patent: Nov. 21, 1995

[54] PORTABLE PITCHING MOUND

[76] Inventor: John W. Beck, 707 Loda Dr., Cincinnati, Ohio 45245

[21] Appl. No.: 809,381

[22] Filed: Dec. 18, 1991

[51] Int. Cl.[6] ..... A63B 71/00

[52] U.S. Cl. ..... 273/25

[58] Field of Search ..... 273/25

[56] References Cited

U.S. PATENT DOCUMENTS

| | | | |
|---|---|---|---|
| D. 214,743 | 7/1969 | Goeders . | |
| D. 236,219 | 8/1975 | Goeders . | |
| D. 258,903 | 4/1981 | Goeders . | |
| D. 303,823 | 10/1989 | Eke . | |
| D. 304,359 | 10/1989 | Wright . | |
| D. 315,382 | 3/1991 | Ragsdale . | |
| 3,236,520 | 2/1966 | Friedman . | |
| 3,427,031 | 2/1969 | Scott | 273/195 R |
| 3,479,028 | 11/1969 | Goeders . | |
| 3,703,285 | 11/1972 | Perry | 273/25 |
| 3,837,646 | 9/1974 | Goeders | 273/25 |
| 3,863,387 | 2/1975 | Webster et al. . | |
| 3,869,128 | 3/1975 | Ohashi . | |
| 4,063,729 | 12/1977 | Hollaway . | |
| 4,063,792 | 12/1977 | Hollaway | 273/25 |
| 4,306,718 | 12/1981 | Goeders | 273/25 |
| 4,531,733 | 7/1985 | Hall . | |
| 4,561,653 | 12/1985 | Wright | 273/25 |
| 4,666,155 | 5/1987 | Stille | 273/25 |
| 4,749,223 | 6/1988 | Goeders | 273/25 |
| 4,779,796 | 10/1988 | Lai | 273/195 B |
| 4,810,560 | 3/1989 | Sell . | |
| 4,925,186 | 5/1990 | Stevenson et al. . | |
| 4,979,740 | 12/1990 | Hall | 273/25 |

OTHER PUBLICATIONS

Osborne Innovative Products, Incorporated, 1992 Catalog, selected pages.

*Primary Examiner*—Theatrice Brown
*Attorney, Agent, or Firm*—Frost & Jacobs

[57] ABSTRACT

A lightweight portable pitching mound for indoor and outdoor use. The mound comprises an expanded plastic core, all exposed surfaces of which are covered with a flexible, sheet-like artificial turf material. The bottom of the mound is planar and preferably covered with an anti-slip material when the mound is used indoors. In a first embodiment, the mound comprises a single, unitary, one-piece, ramp-like structure having a top surface with a planar horizontal part and a planar part extending forwardly and downwardly therefrom. The mound has vertical front, rear and side peripheral surfaces. The top surface parts and the peripheral surfaces are covered with the artificial turf material. The top surface horizontal part supports a conventional rubber. In a second embodiment, the mound comprises three pieces, a central and two side sections which, when assembled in side-by-side abutting relationship, form a rectangular mound having narrow, vertical, rectilinear side, front and rear peripheral edges. The central section has a planar, horizontal, rectilinear, top surface part supporting a conventional rubber and having front, rear and side edges parallel to the corresponding front, rear and side peripheral mound edges. The central and side sections, when assembled, having top surface parts forming four planar trapezoidal surfaces, each sloping downwardly and outwardly from an edge of the horizontal top surface part to the corresponding peripheral edge of the mound. The top surface parts and the peripheral edges of the mound are covered with the artificial turf material.

16 Claims, 9 Drawing Sheets

PORTABLE PITCHING MOUND

TECHNICAL FIELD

The invention relates to a portable pitching mound, and more particularly to such a mound which is extremely lightweight, suitable for indoor and outdoor use, and which gives the user the cushioned feel of an earth mound.

BACKGROUND ART

Prior art workers have devised many types of portable pitching mounds. For the most part, the prior art portable pitching mounds comprise a moulded fiberglass shell in part, at least, covered with a resilient material, an artificial turf material, or the like. Examples of such mounds are taught in U.S. Pat. Nos. 4,306,718 and 4,749,223. U.S. Pat. No. 3,703,285 teaches a pitchers mound made of plastic material having integral supporting ribs. The bottom surfaces of the mound are provided with a non-skid pad adhesively affixed thereto. U.S. Pat. No. 4,925,186 teaches a portable pitchers mound comprising a plurality of parts. U.S. Pat. No. 3,236,520 teaches a portable baseball training mound, the body of which can be made of foamed plastic, fiberglass, or in the form of a metal shell. The mound is provided with a front shield of rubber or plastic.

The present invention is based upon the discovery that if a portable pitching mound is made with an expanded plastic core, the exposed surfaces (top surfaces and peripheral edge surfaces) of which are covered with a flexible, sheet-like, artificial turf material, the resulting mound is very durable, extremely lightweight, and gives the user the feel of an earth mound. This construction can be used to make a one-piece ramp-like practice mound, or a multi-piece full size mound, as will be described hereinafter. The portable mounds of the present invention are significantly lighter in weight than the prior art mounds and do not require folding or the provision of casters, or the like to assist in transporting the mound. As a result, the mounds of the present invention are easy to store and easy to set up.

By virtue of their construction, the mounds of the present invention are essentially maintenance free and weather proof. The mounds demonstrate limited compression of the surface with nearly a full recovery to the original shape. The mounds can even withstand the use of spiked shoes.

DISCLOSURE OF THE INVENTION

According to the invention there is provided a lightweight portable pitching mound for indoor and outdoor use. The mound comprises an expanded plastic core, all exposed surfaces (top surfaces and peripheral edge surfaces) of which are covered with a flexible, sheet-like, artificial turf material. The bottom of the mound is planar. When the mound is to be used indoors, the bottom is preferably covered with an anti-slip material such as a flexible, sheet-like rubber-based material.

In a first embodiment, the mound of the present invention comprises a single, unitary, one-piece, ramp-like structure having a top surface with two parts, a planar horizontal part and a planar part extending forwardly and downwardly from the horizontal part. The mound has vertical, front, rear and side peripheral surfaces. The top surface of the mound and the peripheral surfaces are covered with the artificial turf material. A conventional rubber is mounted on the top surface horizontal part.

In a second embodiment, the mound is made up of three pieces including a central section and two side sections. The three sections, when assembled in side-by-side abutting relationship, form a rectangular mound having narrow, vertical, rectilinear side, front and rear peripheral edges. The central section has a top surface part which is planar, horizontal and rectangular. This horizontal top surface part has a conventional rubber mounted thereon. The rectangular horizontal top surface part has front, rear and side edges which are parallel to the corresponding front, rear and side peripheral edges of the mound.

When the central and side sections are assembled in side-by-side relationship, they have top surface parts which form four planar trapezoidal surfaces. Each planar trapezoidal surface slopes downwardly and outwardly from one of the front, rear and side edges of the horizontal top surface part to the corresponding front, rear or side peripheral edge of the mound. The top surface parts and the peripheral edges of the mound are covered with the artificial turf material. The bottom surfaces of the central and side sections are planar and are preferably covered with a sheet-like, flexible, anti-slip material, when the mound is to be used indoors.

DESCRIPTION OF THE PREFERRED EMBODIMENTS

Figure 1:
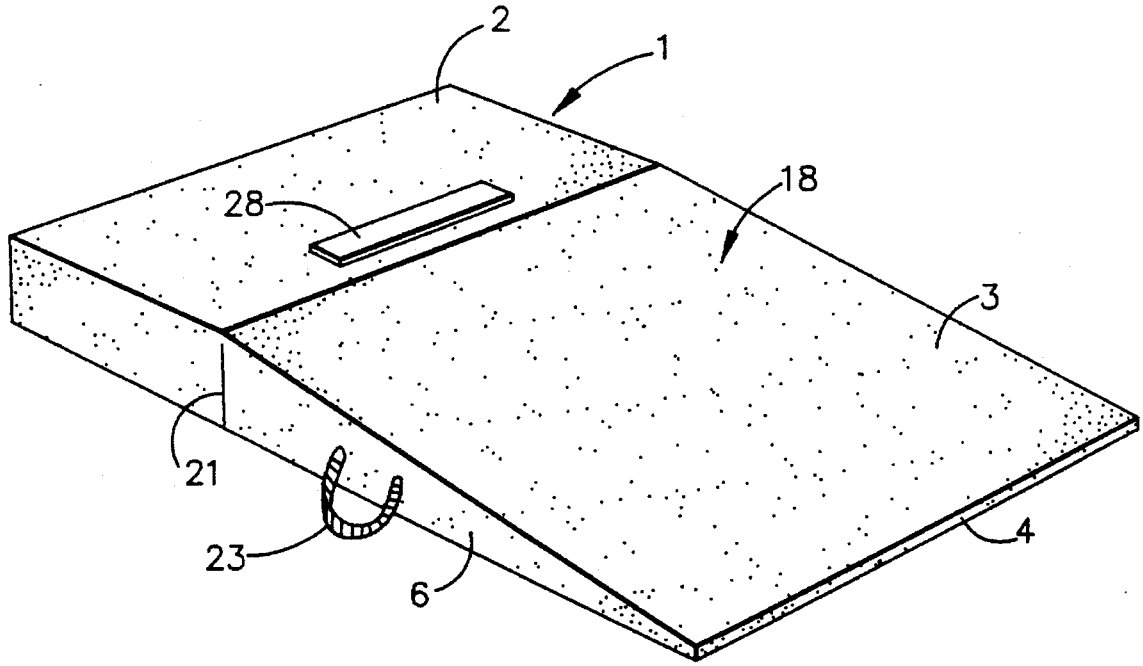
FIG. 1 is a perspective view of the portable pitching mound of the present invention.
Figure 2:
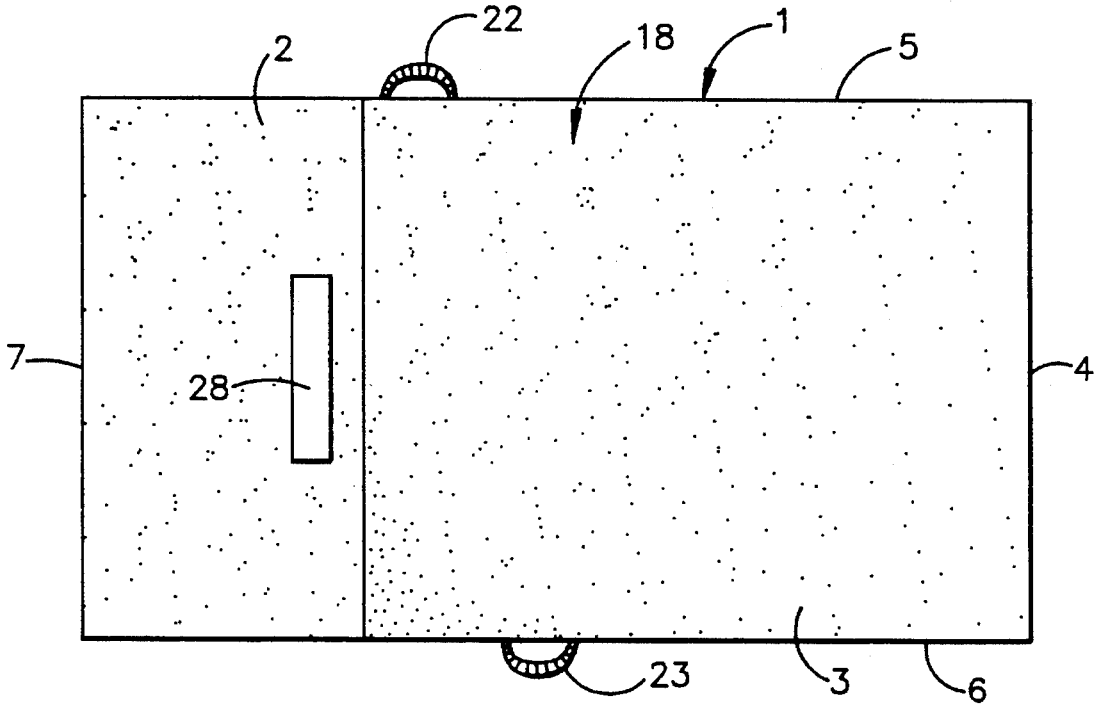
FIG. 2 is a plan view of the pitching mound.
Figure 3:
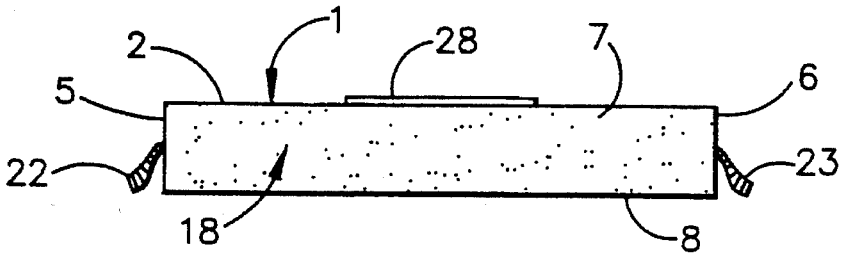
FIG. 3 is a rear elevational view of the pitching mound.
Figure 4:
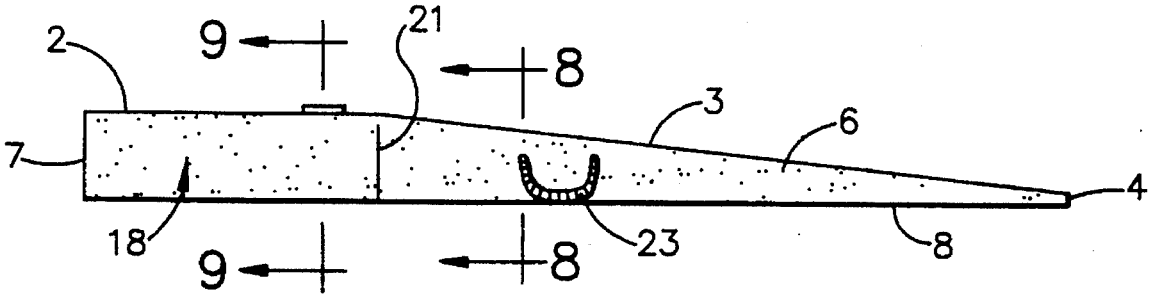
FIG. 4 is a right side elevational view of the pitching mound.
Figure 5:
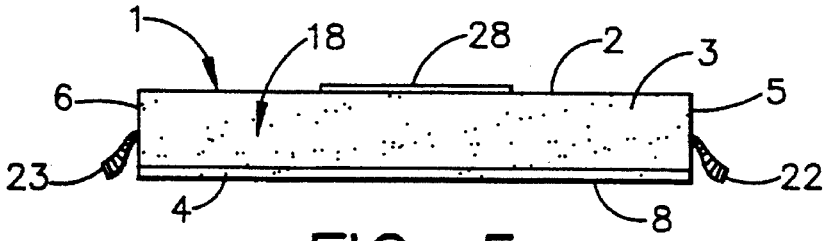
FIG. 5 is a front elevational view of the pitching mound.

Reference is first made to FIGS. 1 through 5 wherein a first embodiment of the portable pitching mound of the present invention is illustrated. The pitching mound is generally indicated at 1 and comprises a structure having a horizontal top surface portion 2, and a forwardly and downwardly sloping top surface portion 3. The pitching mound 1 has a forward vertical edge 4, vertical side edges 5 and 6, and a vertical rear edge 7. As can be clearly seen in FIGS. 3 through 5, the pitching mound 1 has a planar bottom 8.

Figure 7:
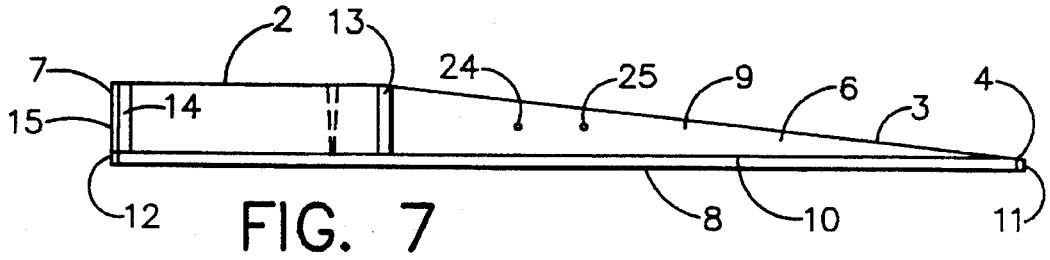
FIG. 7 is a right side elevational view of the core of the pitching mound.

Reference is now made to FIG. 7. The portable pitching mound 1 comprises a solid core 9 of expanded plastic material. Excellent results have been achieved utilizing two-pound density expanded polystyrene. This material is weather resistant, very durable, and is very light weight. The core 9 defines the previously described surfaces of the pitching mound and like index numerals have been applied to FIG. 7.

Along the lowermost portions of vertical front edge 4, vertical rear edge 7 and vertical side edges 5 and 6, wood strips are applied to the core 9. Wood strip 10 is shown extending along the core side 6. Wood strip 11 is shown extending along the core front 4 and wood strip 12 is shown extending along core rear 7. It will be understood that a wood strip (not shown), similar to strip 10, is similarly applied to the side 5 (not shown in FIG. 7). An additional wood strip 13 is affixed to side 6. The strip 13 extends vertically downward from the juncture of core top surfaces 2 and 3 to the strip 10. It will be understood that a similar strip (not shown) is applied to the core side 5 in the same manner.

At the right rear corner of the core 9 a vertical wooden strip 14 is affixed to core side 6 and a similar vertical wood strip 15 is affixed to the rear surface 7. Wood strips 14 and 15 extend upwardly from strips 10 and 12, respectively, to the planar surface 2. It will be understood that the left rear corner of core 9 will be similarly provided with a pair of wooden strips equivalent to strips 14 and 15. All of the wood strips thus far described can be affixed to the core 9 in any suitable manner. For example, an appropriate adhesive can be utilized. Excellent results have been achieved using the household adhesive sold under the trademarks MACCO® and LIQUID NAILS® by the Glidden Company of Cleveland, Ohio. While not required, it is preferred that the core 9 be notched for each wood strip so that the outside surface of each wood strip is flush with the adjacent surface of core 9.

Figure 6:
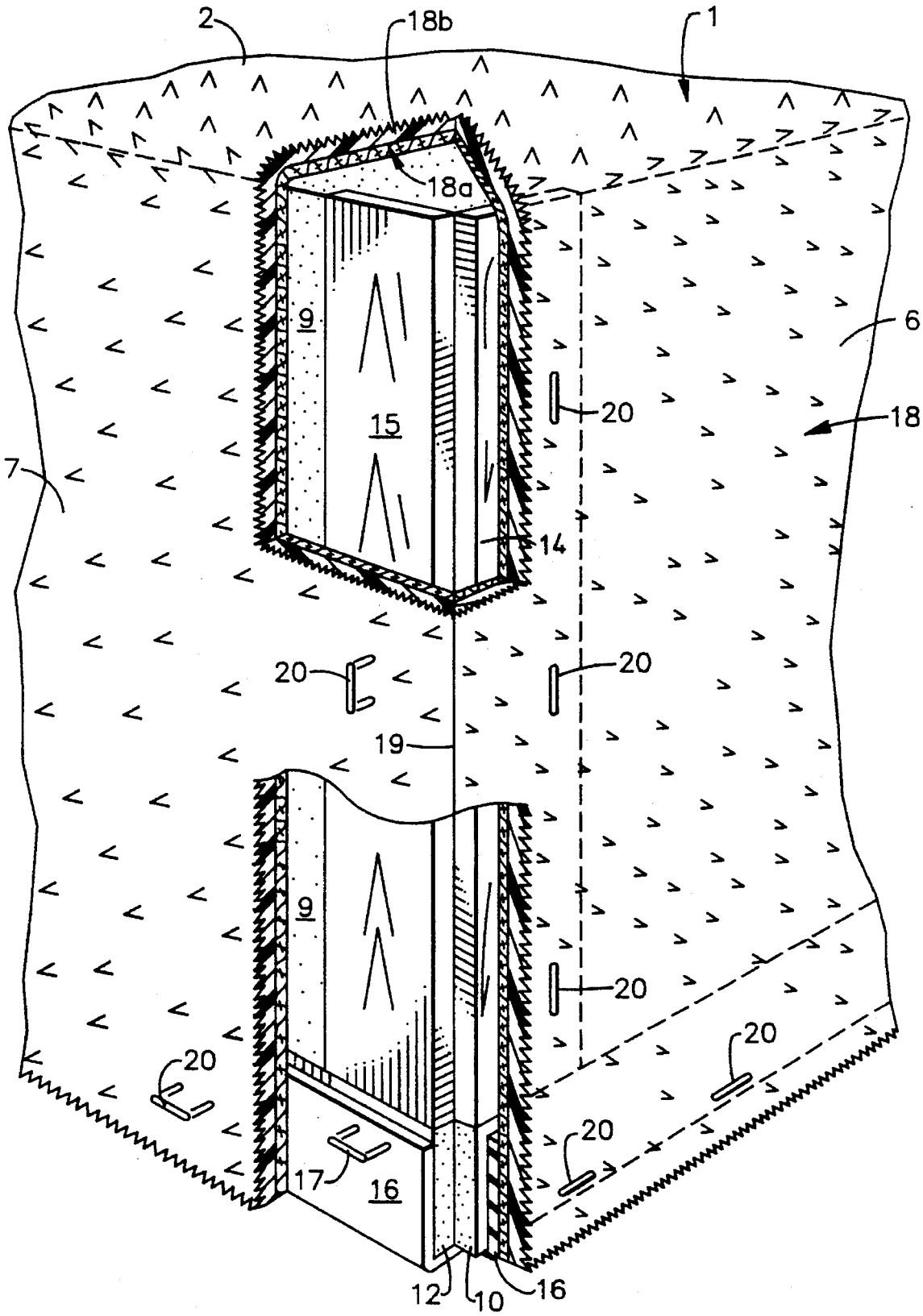
FIG. 6 is a fragmentary perspective view of a rear corner of the pitching mound, partly in cross-section to show the construction thereof.

FIG. 6 is a fragmentary perspective view, partly in cross-section, and clearly illustrates the right rear corner of the pitching mound 1. Wood strips 10, 12, 14 and 15 are shown in FIG. 6.

When the pitching mound 1 is to be used indoors, it is preferable to cover the planar bottom surface 8 of the mound with a flexible anti-slip material. The anti-slip material serves two purposes. First of all, it will prevent the pitching mound from shifting along the floor on which it is supported during use. Furthermore, it will prevent the pitching mound from marring the floor surface. Any appropriate anti-slip material can be used. Excellent results have been achieved, for example, using a rubber based flexible material sold under the trademark SLIP KNOT by Vanguard Industries, Atlanta, Ga.

Such anti-slip material is illustrated at 16 in FIG. 6. The anti-slip material 16 is affixed to the mound by folding its edges upwardly along the peripherally extending wood strips and stapling the edges to the wood strips as shown in FIG. 6. In FIG. 6 edges of the anti-slip material 16 are shown folded upwardly along wood strips 10 and 12 and are affixed thereto by staples. One such staple is illustrated at 17. It will be understood that the remaining edges of anti-slip material will be similarly stapled to strip 11 and the strip equivalent to strip 10, located on the side 5 of pitching mound 1. The four corners of the flexible anti-skid material can be so trimmed as to form vertical abutting seams at the four corners of the pitching mound. Where the portable pitching mound is intended for outdoor use, the layer of anti-slip material 16 can be eliminated.

The remainder of the pitching mound 1 (i.e. top surfaces 2 and 3, front and rear edges 4 and 7, and side edges 5 and 6) is covered with a flexible, sheet-like artificial turf. This is clearly shown in FIGS. 1 through 6, wherein the artificial turf is generally indicated at 18. There are a number of flexible, sheet-like, artificial turf materials available for this purpose. Excellent results have been achieved, for example, with the sheet-like artificial turf material sold under the mark PRO TURF by General Felt Industries Companies of Saddle Brook, N.J.

The artificial turf material 18 covering the mound 1 preferably constitutes a single, unitary, one-piece sheet. As is clearly shown in FIG. 6, the artificial turf material 18 comprises an interior base layer **18*a* and an exterior "turf" layer 18*b*. The artificial turf covering 18 is affixed to the mound core 9 by being stapled to the horizontal wood strips extending about the mound core. This includes wood strips 10, 11 and 12, together with the wood strip, (not shown) equivalent to strip 10 located on the side 5 of the core 9**.

At the four corners of the mound, the artificial turf covering is so trimmed as to form vertical, abutting seams. Such a seam is shown, for example, in FIG. 6 at 19. The artificial turf covering is shown stapled to wood strips 10, 12, 14 and 15, as at 20. It would be obvious to one skilled in the art that the number of staples used and the spacing therebetween should be sufficient to provide a good and tight fit of the artificial turf covering over the pitching mound core 9. It will be further understood that the other rear corner of the pitching mound will be treated in the same manner described with respect to FIG. 6. The front corners of the mound 1 are similarly seamed. The front corners are sufficiently low, that staples in the wood strips 10, 11 and the counterpart of 10 on side 5 will be sufficient to mount the artificial turf covering and to form the vertical corner seams.

Since the top planar surfaces 2 and 3 are angularly related, a narrow V-shaped slot is cut in both sides of the artificial turf covering. When the artificial turf covering 18 is applied to the core 9, the V-shaped slot on the right side of the core will close to form a vertical abutment seam overlying wood strip 13. As a consequence, both sides of this vertical seam can be stapled to vertical strip 13. It will be understood that the narrow V-shaped notch in the left side of the covering will form a similar vertical abutment seam on the left side of core 9 overlying the vertical strip (not shown) constituting the counterpart of vertical strip 13. The vertical seam on the right side of the mound 1 is clearly shown at 21 in FIGS. 1 and 4.

While not a requirement, the portable pitching mound of the present invention can readily be provided with handle means for ease of transport. To illustrate this, the portable mound is shown provided with a pair of handle means 22 and 23 in FIGS. 1 through 5. While the handle means may be of any appropriate type, strap-like handles are preferred. For this purpose, any appropriate strap material can be used, so long as it is strong enough and preferably weather proof. Nylon strapping has been found excellent for this purpose.

Figure 8:
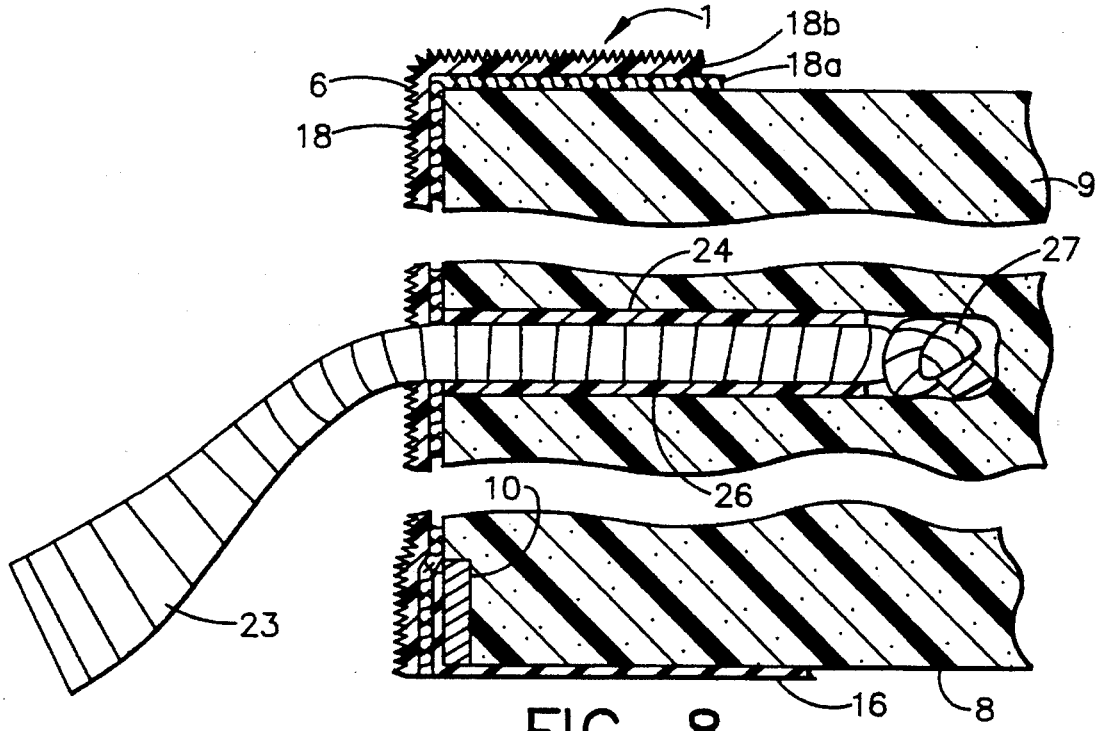
FIG. 8 is a fragmentary cross-sectional view taken along section line 8—8 of FIG. 4.

Reference is made to FIGS. 7 and 8. FIG. 8 is a cross-sectional view taken along section line 8—8 of FIG. 4. In order to mount the handle 23, the core 9 is provided with a pair of perforations 24 and 25 extending inwardly from side edge 6. As will be apparent from FIG. 8, the bore 24 also passes through the layer of synthetic turf 18. The same is true of bore 25.

One end of strap 23 is caused to pass through a section of pipe 26. The strap end is formed into a knot 27. The knot 27 precludes the strap from being removed from the pipe 26. The knotted strip end 27 and the pipe 26 are inserted in the bore 24. The bore 24 is so sized as to receive pipe 26 with a snug fit. The pipe 26 may be permanently fixed within bore 24 through the use of an appropriate adhesive, such as the LIQUID NAILS®, mentioned above. It will be understood that the other end of strap 23 will be caused to pass through another section of pipe (not shown) and knotted. That assembly will then be inserted in perforation 25 in the same manner described with respect to FIG. 8. In this way, the ends of strap-like handle 23 are firmly anchored in the core 9. While not necessarily so limited, excellent results have been achieved using nylon strap of a width of about ¾ inch and 1 inch PVC piping. It will be understood that the handle means 22 will be mounted on the side edge 5 of the mound 1 in the same manner described with respect to FIG. 8. It will further be understood that handle means of the type just described can be provided in any desired number and at any desired location. The staggered location of handles 22 and 23, as shown in the FIGS., provides proper balance during transport of the mound 1.

The embodiment thus far described is completed by the provision of a conventional rubber. A conventional rubber is illustrated in FIGS. 1 through 5 at 28.

Figure 9:
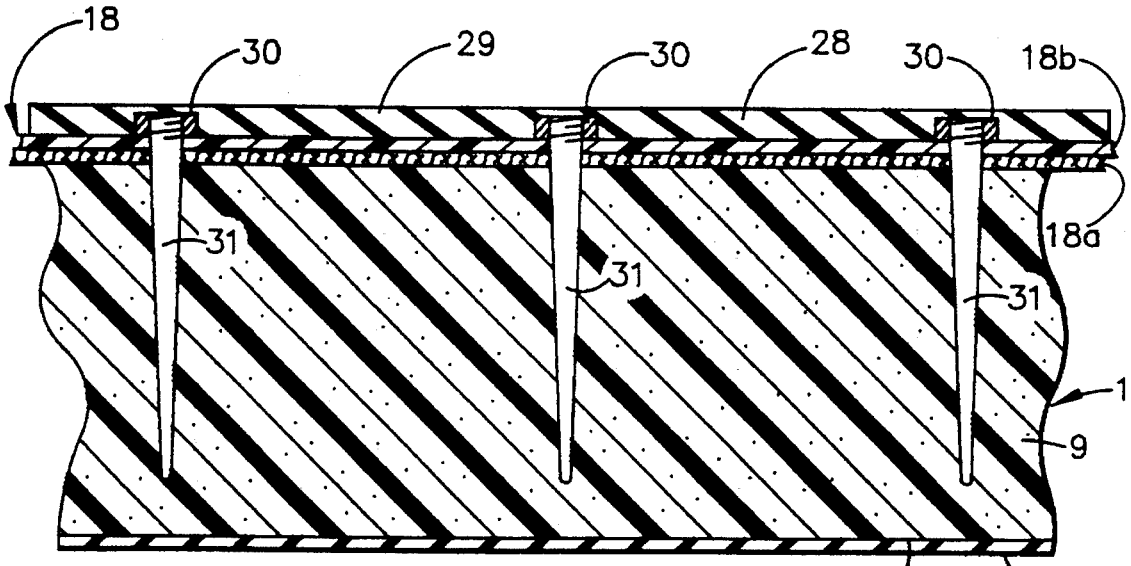
FIG. 9 is a fragmentary cross-sectional view taken along section line 9—9 of FIG. 4.

Reference is made to FIG. 9. FIG. 9 is a fragmentary cross-sectional view taken along section line 9—9 of FIG. 4. The conventional rubber 28 comprises a rectangular rubber body 29. Mounted within the body 29, extending upwardly from the bottom surface thereof, there are a number of threaded fittings 30. Threadedly engaged in each of the fittings 30 there is a downwardly depending spike 31, all as is known in the art. The rubber 28 is mounted by causing the spikes 31 to pass through the artificial turf layer 18 and into the core 9, as shown in FIG. 9. The spikes 31 may be fixed within the core 9 by the use an appropriate adhesive, such as the LIQUID NAILS®, mentioned above.

The mounting of the rubber 28, illustrated in FIG. 9, is particularly appropriate for the portable pitching mound of the present invention when it is intended to be used indoors and is provided with the bottom most layer of anti-slip material 16. When the portable pitching mound is intended to be used outdoors, and the anti-slip layer 16 is not used, the rubber 28 may be mounted as described with respect to FIG. 9, or it may be mounted as illustrated in FIG. 10.

Figure 10:
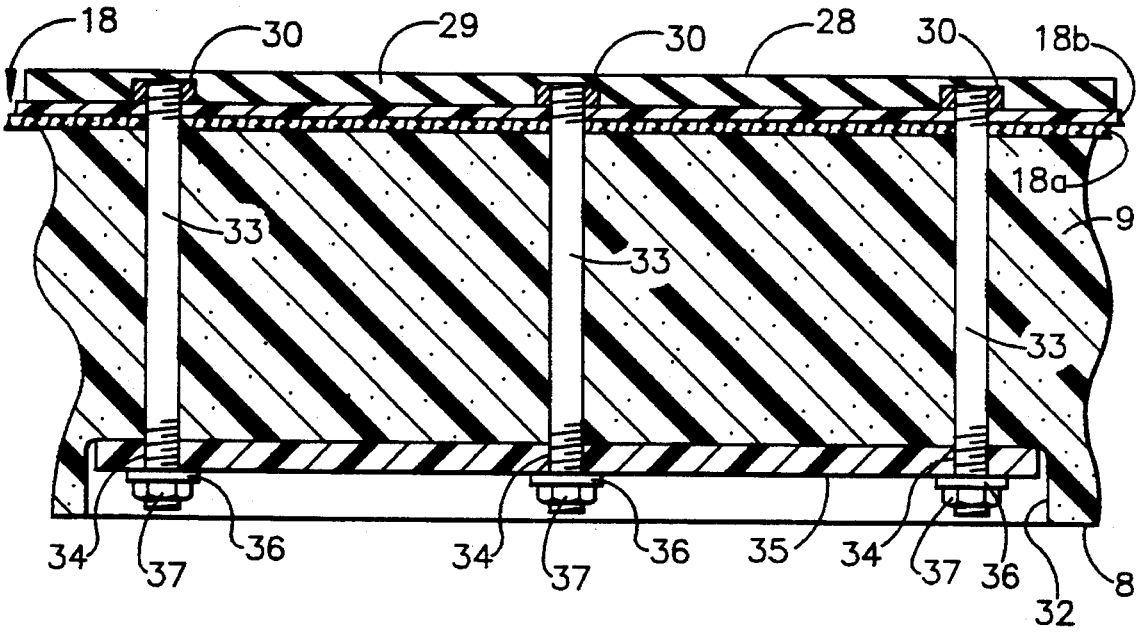
FIG. 10 is a fragmentary cross-sectional view, similar to FIG. 9, and illustrating an alternative mounting of the rubber.

In FIG. 10, like parts have been given like index numerals. It will be noted that in this outdoor version of the portable pitching mound of the present invention, the anti-slip layer 16 has been eliminated. In addition, a recess 32 has been formed in the bottom 8. The recess 32 may have a substantially rectangular peripheral configuration. It will further be noted that the spikes 31 of FIG. 9 have been replaced by threaded rods 33. The upper ends of rods 33 are threadedly engaged in the fittings 30 within the body 29 of rubber 28. While not required, the rods 33 may be made of conventional threaded metallic rod stock of appropriate diameter. It will be noted that the threaded rods 33 extend through the artificial turf layer 18 and the core 9 into the recess 32. The lower ends of threaded rods 33 extend through perforations 34 in a planar retainer plate 35. The retainer plate 35 may be made of any appropriate material including metal, wood, plastic or the like. The structure is completed by providing a washer 36 and a nut 37 for the lowermost end of each of the threaded rods 33. The nuts 37 are tightened until the rubber 28 is firmly secured on the pitching mound 1. It will be noted that the recess 32 formed in the bottom surface 8 of the core 9 is so dimensioned so as to accommodate the retainer plate 35 and the ends of the threaded rods 33. This method of mounting the rubber enables its easy removal for replacement of the artificial turf covering 18. The artificial turf covering 18 is usually subjected to greater wear on an outdoor mound because of the use of spiked shoes.

The embodiment thus far described provides a lightweight, portable pitching mound which can be easily carried and handled. The two-pound density expanded polystyrene core and artificial turf cover gives the pitcher the cushioned feel of an earth mound. The structure is ideal for use indoors and will not mar or slip along the floor upon which it is supported. The structure is also ideal for outdoors, being weather proof and substantially maintenance free. The portable pitching mound of the present invention demonstrates limited compression of the surface, with nearly full recovery to its original shape. It will withstand the use of spiked shoes. By virtue of its lightweight construction, the portable pitching mound is easy to store and easy to set up.

The embodiment thus far described can be easily made in various predetermined sizes and in custom sizes, if required. For example, it can be sized meet National League requirements. As a non-limiting example, the portable pitching mound could be made in sizes adapted for particular age groups. For example, for ages 6 to 12, the portable mound could be made 72 inches long, 48 inches wide and six inches high. For high school players, ages 13 through 18, the portable pitching mound could be made 48 inches wide, 114 inches long and 10 inches high. For use by college and professional players, the mound could be made 64 inches wide, 114 inches long and 10 inches high.

Figure 11:
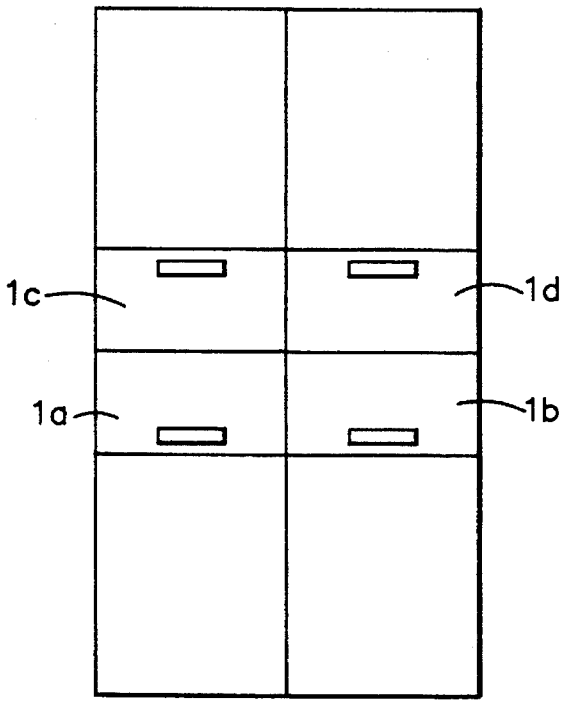
FIG. 11 is a simplified plan view illustrating four pitching mounds, of the type illustrated in FIG. 1, arranged in a cluster.

The fact that the side edges 5 and 6 and the rear edge 7 of the mound 1 are vertical, enables a number of mounds to be arranged back-to-back, or side-to-side, or both. FIG. 11 is a simplified plan view illustrating four portable pitching mounds of the present invention arranged in a cluster. The mounds are indicated at 1*a*, 1*b*, 1*c* and 1*d*. Arranging the mounds side-by-side or back-to-back provides an economy of space. Furthermore, when the mounds are arranged side-by-side (such as mounds 1*a* and 1*b*, for example), a pitcher standing on mound 1*a* can practice a throw to first base by stepping off onto mound 1*b*. Similarly, if the pitcher stands on mound 1*b*, he can practice a throw to third base by stepping off onto mound 1*a*. When the mounds are arranged back-to-back (as for example mounds 1*a* and 1*c*), the pitcher can practice a throw to second base from mound 1*a* by stepping onto mound 1*c*. From the above description, it will be obvious that when three or more mounds are arranged in a cluster, the pitcher can practice throws to all bases.

When used outdoors, the portable pitching mound can be set up for practice pitching, and is excellent for use in bull pens and the like. The portable pitching mound, if properly sized, can be used as a part of the mound in the playing field, the remainder of the mound comprising dirt properly arranged about the portable pitching mound.

A second embodiment of the portable pitching mound of the present invention is illustrated in FIGS. 12 through 17. In these FIGS. like parts have been given like index numerals.

The portable pitching mound of FIGS. 12 through 17 is generally indicated at 38 and comprises three sections. A central section is indicated at 39 and a pair of mirror image side sections are indicated at 40 and 41. As is most clearly shown in FIGS. 12, 14, 16 and 17, the portable pitching mound 38, when ready for use, is arranged with the side sections 40 and 41 in side-by-side abutting relationship with center section 39. The purpose of this second embodiment of the portable pitching mound of the present invention is to provide a complete mound which can be used outdoors, or indoors (as in a collegiate indoor facility). When made in proper size, the portable pitching mound can be used in the playing of a actual game. The second embodiment has all of the advantages of the previously described first embodiment, including lightweight, weather proof, limited compression and excellent recovery, and providing the cushioned feel of an earth mound. The use of the second embodiment eliminates problems associated with rebuilding dirt mounds, and provides greater uniformity and safety.

Figure 13:
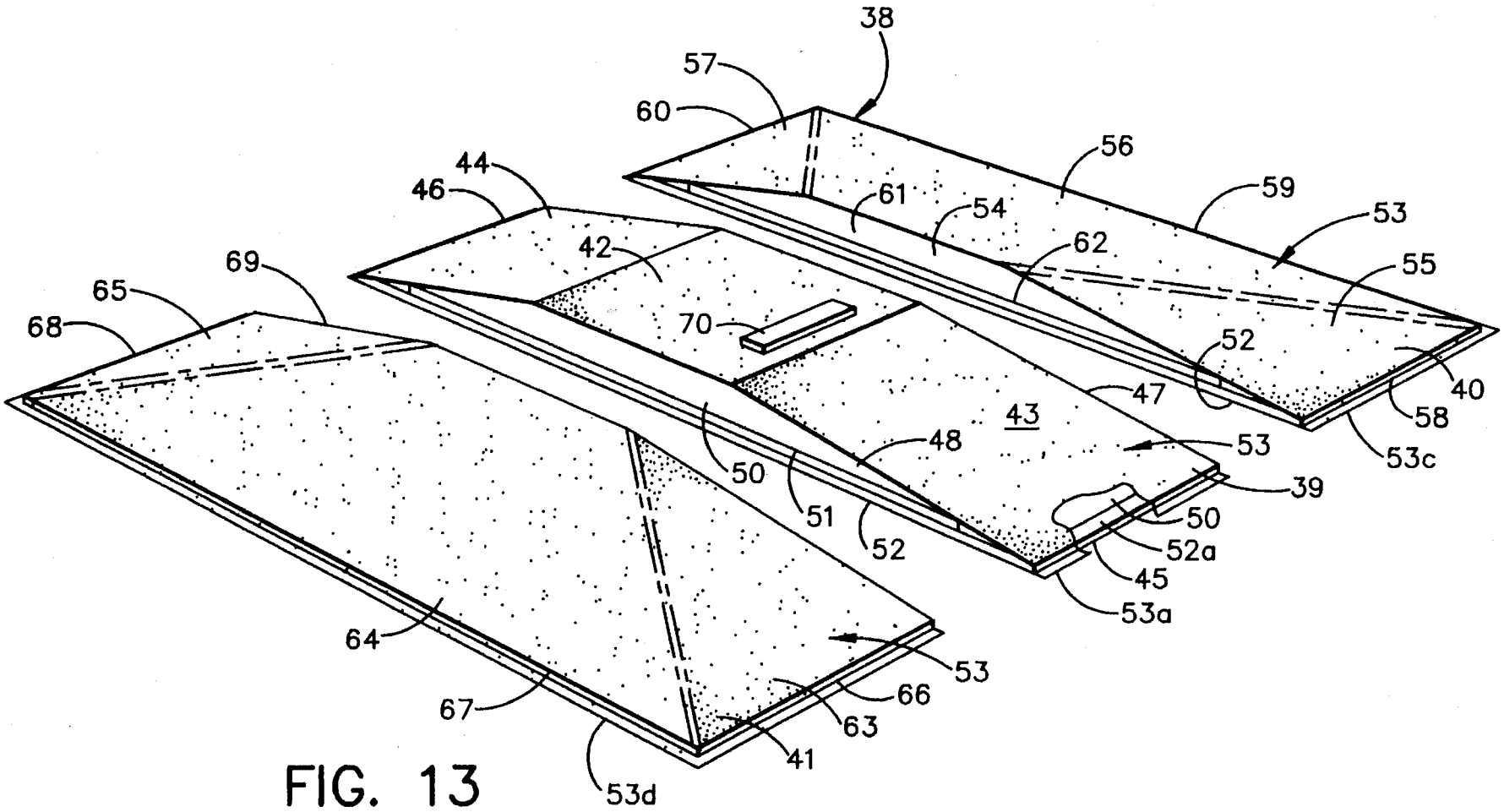
FIG. 13 is an exploded perspective view of the embodiment of FIG. 12.
Figure 14:
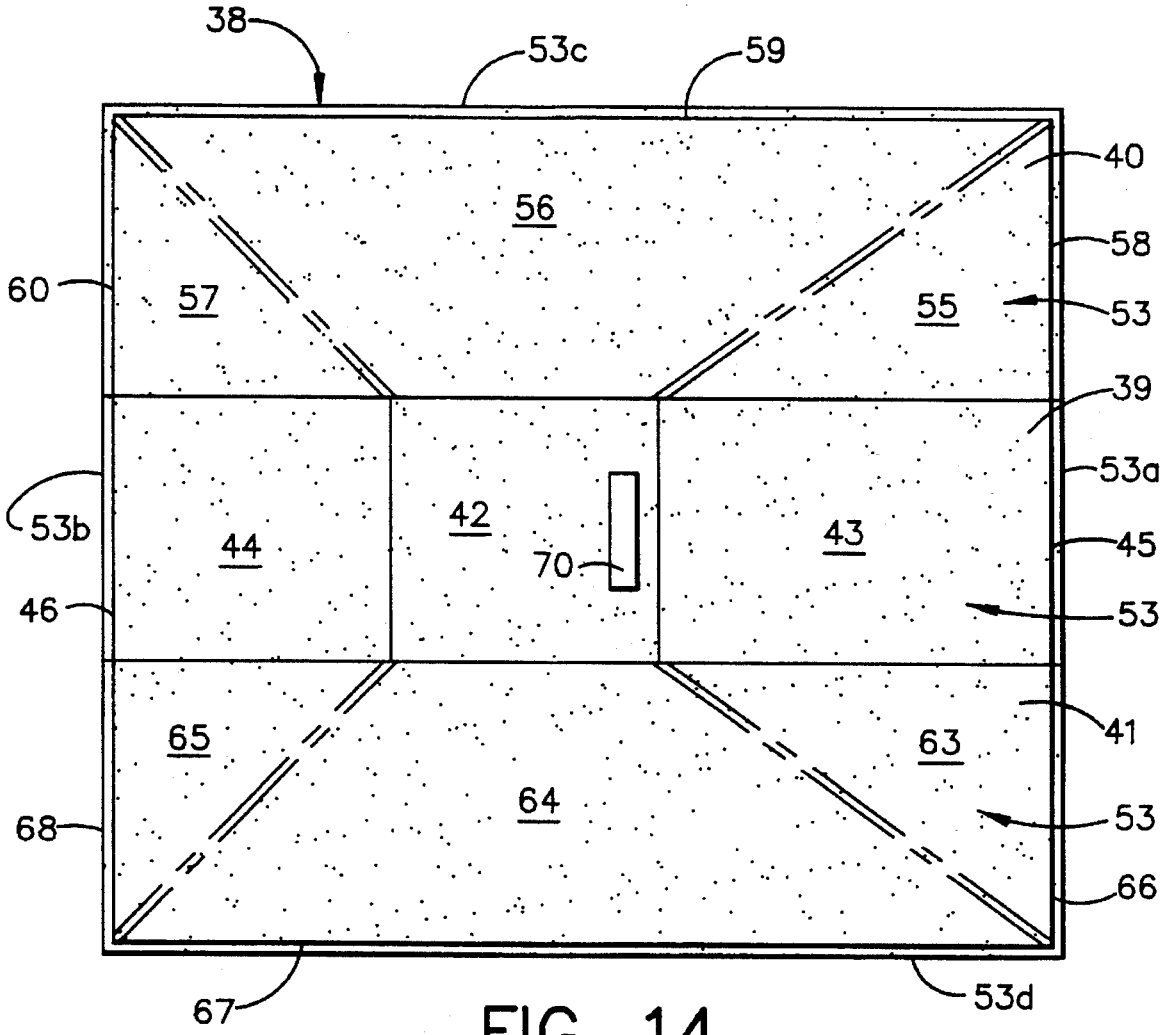
FIG. 14 is a plan view of the embodiment of FIG. 12.
Figure 15:
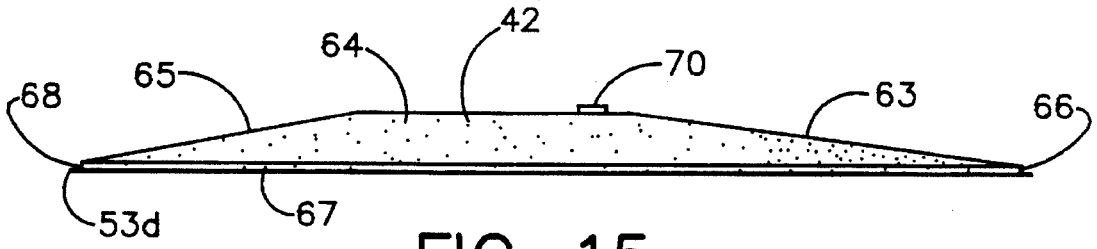
FIG. 15 is a right side elevational view of the embodiment of FIG. 12.
Figure 16:
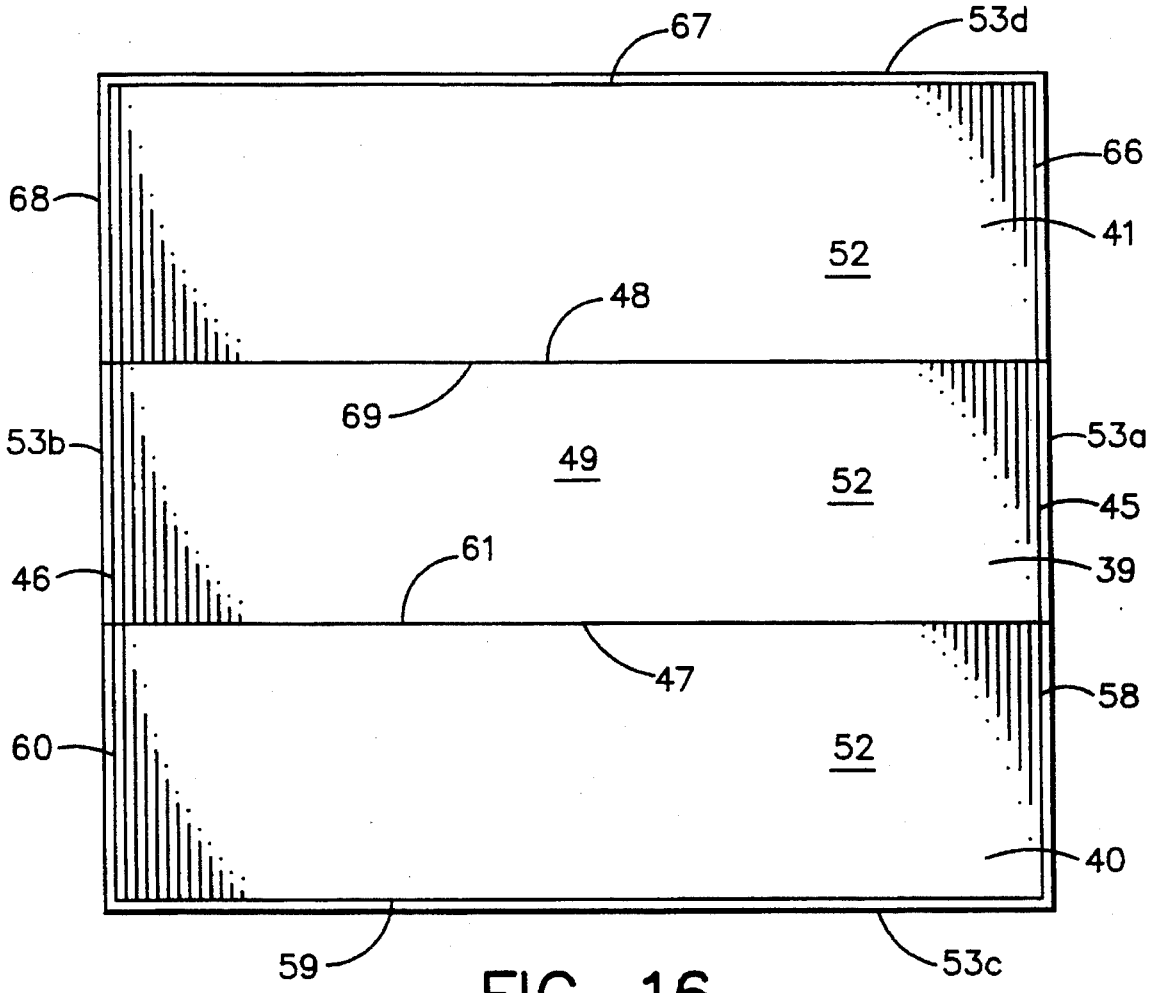
FIG. 16 is a bottom view of the embodiment of FIG. 12.
Figure 17:
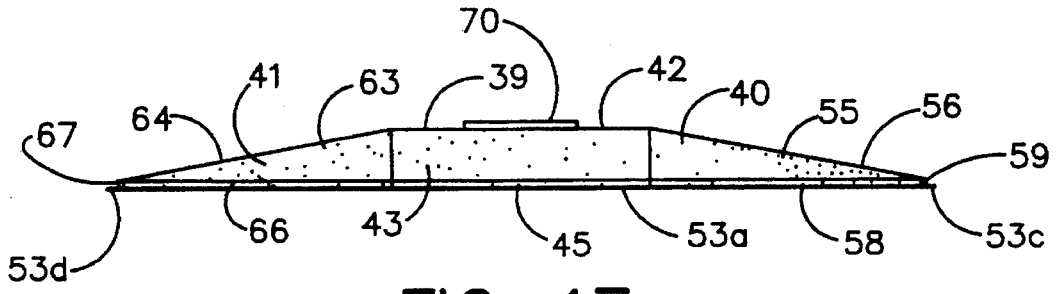
FIG. 17 is a front view of the embodiment of FIG. 12.

FIG. 13 illustrates the three sections 39, 40 and 41 of the mound 38 in separated positions. The central section 39 has a top surface made up of three parts. There is a rectangular horizontal part 42, and forward part 43 which slopes downwardly and forwardly from horizontal part 42, and a rear part 44 which slopes downwardly and rearwardly from part 42. The central section also has a vertical forward edge 45, a vertical rearward edge 46, and vertical side edges 47 and 48. The central section 39 has a planar bottom surface 49, best shown in FIG. 16.

The central section 39 comprises a core 50 of expanded plastic material. Preferably, the core 50 is made of the same material described with respect to the core 9 of FIG. 7 (i.e. two-pound density expanded polystyrene).

When the mound 38 is intended for indoor use, it is preferable to cover the bottom surface 49 of the central section 39 with an anti-slip material. Any appropriate flexible, sheet-like anti-slip material may be used, including the material described with respect to the covering 16 of the first embodiment. To this end, the foam core 50 of the central section has a strip of wood let into each of the sides 47 and 48 along its bottom edge. For this purpose, wood strip material approximately ¼ inch thick and 1¼ inch wide will serve the purpose well. Again, it is preferable that the outside surfaces of the strips be co-planar with the adjacent side surfaces of the core 50. Such a strip of wood is shown let into side 48 of the central section 39 and indicated by index numeral 51. It will be understood that a similar strip will be provided on side 47. A layer of anti-slip material 52 covering the bottom 47 of the central section 39 has a longitudinal edge portion pulled upwardly along wood strip 51 and stapled thereto. The other longitudinal edge of the anti-slip layer 52 will be similarly stapled to the wood strip (not shown) extending along the central section side 47. Where there is no wood strip and along the front and rear edges 45 and 46 the anti-slip material is glued to the core 50. Along the front and rear edges of the central section 39, the anti-slip material may be folded several inches along surfaces 43 and 44 and glued thereto. This is shown at 52*a* in FIG. 13. It will be understood by one skilled in the art that, when the mound 38 is intended for outside use, the anti-slip layer 52 is eliminated and there is no need for the wood strips such as strip 51. The front and rear edges 45 and 46, and the top surfaces 42, 43 and 44 are covered with an artificial turf material generally indicated at 53. Any appropriate flexible, sheet-like artificial turf material can be used for this purpose, including the material described with respect the artificial turf covering 18 of the first embodiment. In this instance, however, the artificial turf covering 53 is glued to the core 50 at the surfaces 42, 43 and 44 of the central section 39, and its forward and rearward edges 45 and 46. When the anti-slip layer 52 is present and extends over the forward and rearward edges 45 and 46 and partway onto surfaces 43 and 44, the artificial turf layer 53 is glued directly over the anti-slip material. Any appropriate adhesive for this purpose can be used. Again excellent results have been achieved utilizing the above-described LIQUID NAILS®. The artificial turf layer 53 is so trimmed that a narrow border of the material extends from the forward and rearward edges 45 and 46 of central section 93. These narrow borders are indicated at 53*a* and 53*b*.

The side section 40 comprises a foamed plastic core 54. Again the core is preferably made of two-pound density expanded polystyrene. The section 40 has an upper surface comprising three parts including a planar front part 55 with a triangular peripheral configuration, a planar central part 56 with a trapezoidal peripheral configuration and a planar rear part 57 with a triangular peripheral configuration. The section 40 also has a narrow vertical forward edge 58, a narrow vertical outside edge 59, a narrow vertical rear edge 60 and a vertical inner edge 61, constituting a mirror image of the edge 47 of central section 39.

When the section 40 is to constitute a portion of a mound 38 to be used indoors, it will preferably have its planar bottom covered with a layer of anti-slip material such as that described with respect to the layer 16 of the first embodiment. To this end, the inside surface 61 may be provided with a wood strip 62 substantially identical wood strip 51 shown on side 50 of central section 39. The wood strip 62 is let into the side 61 of the core 54, so that its outside surface is co-planar with the surface of side 61. The anti-slip material covering the bottom of section 40 has an edge portion extending upwardly along the wood strip 62 and stapled thereto. Elsewhere, the upturned portion of the anti-slip material is glued directly to the core 54. This is true along edges 58, 59 and 60. The anti-slip material may also extend several inches from the edges 58, 59 and 60 onto the surfaces 55, 56 and 57, respectively, being glued thereto. Any appropriate adhesive material may be used for this purpose, including the LIQUID NAILS®, mentioned above.

The upper surfaces 55, 56, and 57 of section 40 are covered with the same artificial turf material 53 described with respect to central section 39. As in the case of the central section 39, the artificial turf material 53 on section 40 is glued directly the core 54 and to the anti-slip material, where it exists on surfaces 55, 56 and 57 and on edges 58, 59 and 60. At the bottom of the edges 58, 59 and 60, a narrow border of the artificial turf material is provided and is indicated at 53*c*. It will be understood that if the section 40 constitutes a part of a mound 38 intended for outdoor use, the wood strip 62 and the anti-slip material 52 would be eliminated.

The section 41 is a mirror image of the section 40 and is otherwise identical thereto. The section 40 has a core similar to the core 54. The section 41 has an upper surface in three parts, including a forward part 63 of triangular peripheral configuration, a central part 62 having a trapezoidal peripheral configuration, and rear part 65 having a triangular peripheral configuration. The part 63 is a mirror image of the part 55 of section 40. Similarly, the parts 64 and 65 are mirror images of the parts 56 and 57 of the top surface of section 40. The section 41 has a narrow vertical front edge 66, a narrow vertical outside edge 67, a narrow vertical edge 68 and an inner edge 69 which is a mirror image of the adjacent edge 50 of central section 39. If the overall mound 38 is intended for use indoors, the section 41 will have its planar bottom surface covered with the anti-slip material 52. When this is the case, the side 69 will be provided with a wood strip similar to the strips shown at 51 and 54 in FIG. 13, to enable the anti-slip material to be stapled thereto. Again, the top surfaces 63, 64 and 65, together with the edges 66, 67 and 68 will be covered with the artificial turf material 53. At the bottom of the edges 66, 67 and 68 there will be a narrow border of the artificial turf material, similar to the border 53*c* on section 40 and indicated at 53*d*.

The central section 39 supports a conventional rubber 70. The rubber 70 can be mounted on the central section 39 in either of the ways described with respect to FIGS. 9 and 10, above.

Each of the sections 39, 40 and 41 are lightweight and can be easily carried by a single person. When the mound is set up for use, the sections 40 and 41 will be located in abutment with the sides 47 and 48 of central section 39, as illustrated in FIGS. 12, 14, 16 and 17.

The mound of FIGS. 12 through 17 can be made in any size and can be appropriately sized for use in actual games. While size is not a limitation of the present invention, the following is a description of an exemplary mound which has been built. In the exemplary mound, the sections 40 and 41 were both 4 feet wide and 13 feet long. The central section 39 was 3 foot 9 inches wide and 13 feet long. As viewed in plan in FIG. 14, the central horizontal part 42 of the top surface of central section 39 was 46 inches from front to rear. The portion 43 of the top surface of central section 39 was 68 inches from front to rear and the part 44 of the top surface of central section 39 was 4 feet from front to rear.

Figure 12:
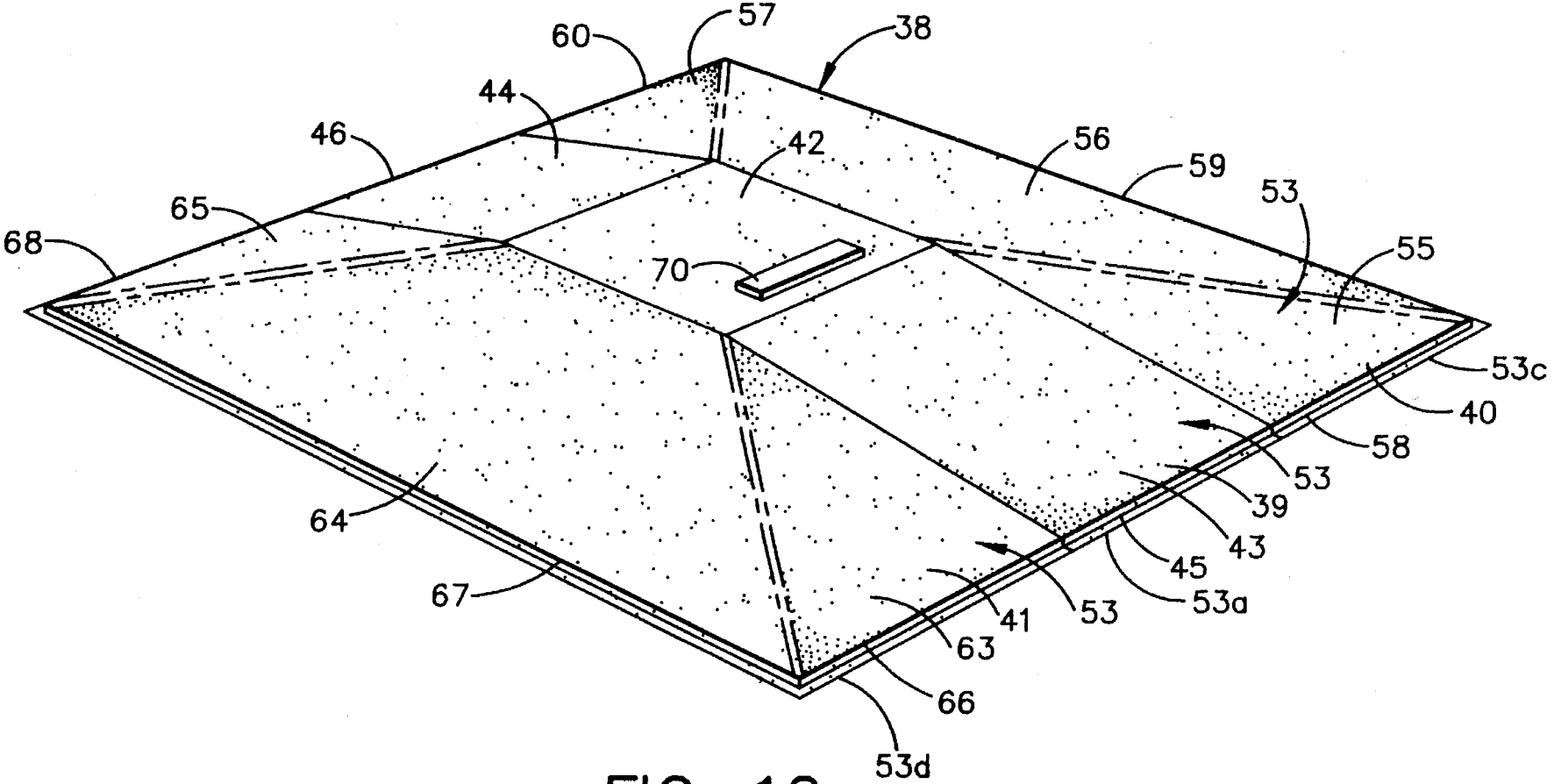
FIG. 12 is a perspective view of a second embodiment of a portable pitching mound according to the present invention and comprising a central and two-side sections.

As is evident from FIG. 12, when the sections 39, 40 and 41 are put together to form the mound 38, the upper surface portions 57, 44 and 65 are co-planar along the rear of the mound. Similarly, top surface parts 55, 43 and 63 are co-planar along the front of the mound. Top surface part 64 along one side and top surface part 56 along the other side, together with top surface parts 65, 44 and 57 along the rear, all slope downwardly and outwardly from the horizontal top surface part 42 at substantially the same angle. This slope is approximately 2.5 inches per foot. The slope of the forward portion of the mound comprising parts 55, 43 and 63 is approximately 1½ inches per foot.

Aside from the fact that the embodiment of FIGS. 12 through 17 constitutes a full mound, the embodiment also offers all of the advantages described with respect to the embodiment of FIGS. 1 through 11, including the fact that the sections 39, 40 and 41 are lightweight, portable, easy to store, easy to set up and weather proof. The mound 38 can be used indoors or outdoors and provides the pitcher with the cushioned feel of an earth mound. The mound is essentially maintenance free. It eliminates the problems associated with rebuilding dirt mounds, providing both uniformity and safety.

Modifications may be made in the invention without departing from the spirit of it.

I claim:

1. A portable pitching mound comprising an expanded plastic core defining the shape of the mound, a flexible, artificial turf material covering all the top and peripheral edge surfaces of said core, said mound having a planar, horizontal, top surface part on which a conventional rubber is mounted, said mound having a planar bottom.

2. The mound claimed in claim 1 wherein said core is made of two pound density expanded polystyrene.

3. The mound claimed in claim 1 intended for indoor use, said mound having a flexible layer of anti-slip material covering said mound bottom.

4. The mound claimed in claim 1 wherein said rubber has a bottom surface and a plurality of spikes extended downwardly therefrom, said spikes extending through said artificial turf material and into said core, said spikes being fixed within said core by adhesive means.

5. The mound claimed in claim 1 wherein said rubber has a bottom surface and a plurality of threaded rods, threadedly engaged in said rubber and extending downwardly from said bottom surface thereof, said threaded rods extending through said artificial turf material and said core into a recess formed in said bottom surface of said core, said threaded rods extending through a mounting plate located within said recess and abutting said core, the lowermost ends of said threaded rods being located within said recess and provided with washers and nuts tightened against said mounting plate.

6. The mound claimed in claim 1 wherein said core comprises a central section and two side sections capable of assembly in side-by-side abutting relationship to form a full size mound.

7. The mound claimed in claim 6 wherein said central and side sections, when assembled in abutting relationship, form a rectangular mound having narrow, vertical, rectilinear, front, rear and side peripheral edge surfaces, said central section having said planar, horizontal, rubber-supporting top surface part, said horizontal top surface part being rectangular and having front, rear and side edges parallel to the corresponding front, rear and side peripheral edge surfaces, said central and side sections having top surface parts which, when the sections are assembled in abutting relationship, form four planar, trapezoidal surface parts, each of which slopes downwardly and outwardly from an edge of said horizontal top surface part to said corresponding parallel peripheral edge surface of said mound.

8. The mound claimed in claim 7 wherein said core sections are made of two pound density expanded polystyrene.

9. The mound claimed in claim 7 intended for indoor use, each of said core sections having a planar bottom, a flexible, sheet-like layer of anti-slip material covering said planar bottom of each of said core sections.

10. The mound claimed in claim 7 wherein said rubber has a bottom surface and a plurality of spikes extending downwardly therefrom, said spikes extending through said artificial turf material and into said central core section, said spikes being fixed within said central core section by adhesive means.

11. The mound claimed in claim 7 wherein said rubber has a bottom surface and a plurality of threaded rods threadedly engaged in said rubber and extending downwardly from said bottom surface of said rubber, said central core section having a planar bottom surface, said threaded rods extending through said artificial turf material and said central core section into a recess formed in said bottom surface of said central core section, said threaded rods extending through a mounting plate located within said recess and abutting said central core section, the lowermost ends of said threaded rods being located within said recess and provided with washers and nuts tightened against said mounting plate.

12. A portable pitching mound comprising an expanded plastic core defining the shape of the mound, said core comprising a single, unitary, one-piece, rectangular, ramp-shaped structure, a top surface on said core comprising a planar, horizontal surface part and a planar part sloping downwardly and forwardly therefrom, peripheral edge surfaces on said core comprising a vertical rear surface, a vertical front surface and vertical side surfaces, a flexible, artificial turf material covering all of said top and peripheral edge surfaces, a conventional rubber mounted on said planar horizontal top surface part, said mound having a planar bottom.

13. The mound claimed in claim 12 wherein said core is made of two pound density expanded polystyrene.

14. The mound claimed in claim 12 intended for indoor use, said mound having a flexible layer of anti-slip material covering said mound bottom.

15. The mound claimed in claim 12 wherein said rubber has a bottom surface and a plurality of spikes extending downwardly therefrom, said spikes extending through said artificial turf material and into said core, said spikes being fixed within said core by adhesive means.

16. The mound claimed in claim 12 wherein said rubber has a bottom surface and a plurality of threaded rods threadedly engaged in said rubber and extending downwardly from said bottom surface thereof, said threaded rods extending through said artificial material and said core into a recess formed in the bottom surface of said core, said threaded rods extending through a mounting plate located within said recess and abutting said core, the lowermost ends of said threaded rods being located within said recess and provided with washers and nuts tightened against said mounting plate.

* * * * *